US006198364B1

(12) United States Patent
Karhu

(10) Patent No.: US 6,198,364 B1
(45) Date of Patent: Mar. 6, 2001

(54) RESONATOR FILTER HAVING A FREQUENCY REGULATING MEANS WITH AT LEAST ONE TURN

(75) Inventor: Kimmo Karhu, Oulu (FI)

(73) Assignee: ADC Telecommunications Oy, Oulu (FI)

( * ) Notice: Subject to any disclaimer, the term of this patent is extended or adjusted under 35 U.S.C. 154(b) by 0 days.

(21) Appl. No.: 09/284,883

(22) PCT Filed: Oct. 24, 1997

(86) PCT No.: PCT/FI97/00651

§ 371 Date: Jun. 2, 1999

§ 102(e) Date: Jun. 2, 1999

(87) PCT Pub. No.: WO98/20575

PCT Pub. Date: May 14, 1998

(30) Foreign Application Priority Data

Oct. 25, 1996 (FI) ..... 964320

(51) Int. Cl.[7] ..... H01P 7/04; H01P 1/20

(52) U.S. Cl. ..... 333/202; 333/219; 333/235; 333/207; 333/223

(58) Field of Search ..... 333/202, 206, 333/207, 219, 222, 223, 235

(56) References Cited

U.S. PATENT DOCUMENTS

| | | | |
|---|---|---|---|
| 4,374,370 | 2/1983 | Opovski et al. | 333/202 |
| 4,422,058 | 12/1983 | Vizmuller | 333/202 |
| 4,682,131 | 7/1987 | May | 333/202 |

FOREIGN PATENT DOCUMENTS

| | | |
|---|---|---|
| 0673077 | of 1995 | (EP) . |
| 95516 | 9/1995 | (FI) . |
| 2235339 | 2/1991 | (GB) . |

*Primary Examiner*—Benny Lee
*Assistant Examiner*—Stephen E. Jones
(74) *Attorney, Agent, or Firm*—Ladas and Parry

(57) ABSTRACT

The invention relates to a resonator filter comprising a housing structure (10), at least one resonator conductor (20) in the housing structure, and a regulating means (30) for regulating the frequency band of the resonator filter. The regulating means (30) is substantially transverse with respect to the propagation direction of the resonator conductor so that the regulating means (30) forms at least one turn around the resonator conductor (20) transversely to the propagation direction of the resonator conductor.

11 Claims, 3 Drawing Sheets

RESONATOR FILTER HAVING A FREQUENCY REGULATING MEANS WITH AT LEAST ONE TURN

BACKGROUND OF THE INVENTION

The invention relates to a resonator filter comprising a housing structure, at least one resonator conductor in the housing structure, and a regulating means for regulating the frequency band of the resonator filter.

Resonator filters are used in base stations of mobile telephone networks, for example. In base stations, resonator filters can be used for instance as matching networks or filtering circuits in amplifiers of transceiver units. There are several different kinds of resonator filters, and a resonator usually comprises a housing or a body. Resonator filters comprising a housing structure are for instance a coaxial resonator filter or an LC filter. The housing structure of a resonator is made of metal. In coaxial resonator structures, for example, the housing structure encloses a conductor situated in the middle area of the cavity of the housing structure, this conductor being called a resonator or a resonator pin. Additionally, it is known to use so-called helix resonators, in which the resonator is formed of a helical resonator conductor.

The length of a resonator pin is generally equal to a fourth of the wavelength of a signal coming to the resonator or to half of said wavelength. For this reason, resonators are very practical in the microwave area. In solutions according to the prior art, the resonator is fastened to the bottom of the housing structure. In a solution, a regulating means implemented by a wire is fastened beside the fixing point of the resonator. The wire forms an inductive coupling. It has been possible to change the frequency band of the resonator by changing the length and the position of the wire.

In another prior art solution, the wire is fastened to the resonator. However, resonators according to the prior art show the problem that they are difficult to tune and regulate accurately to the correct frequency band in the mounting stage. In a further solution according to the prior art, soldering the wire in the resonator has led to tuning problems.

SUMMARY OF THE INVENTION

The object of the present invention is to provide a resonator filter of novel type, which eliminates the problems associated with the prior art solutions.

This object is achieved by means of a resonator filter of the invention, which is characterised in that the regulating means is substantially transverse to the propagation direction of the resonator conductor so that the regulating means forms at least one turn around the resonator conductor transversely to the propagation direction of the resonator conductor.

Many advantages are achieved by means of the resonator filter of the invention. By this solution, the resonator filter can be provided with a coupling that makes the filter easy to regulate accurately to the correct frequency band by using a regulating means. An easy regulation is possible because only a minor change in the frequency filtered by the resonator is provided even if the distance between the turns of the regulating means is changed relatively much, for instance. In addition, the resonator filter of the solution is mechanically durable. Further, the resonator filter is easy and fast to mount in comparison to the prior art solutions.

BRIEF DESCRIPTION OF THE DRAWINGS

In the following, the invention is described in greater detail by referring to the examples of the attached drawings, where.

DETAILED DESCRIPTION OF THE INVENTION

Figure 1:
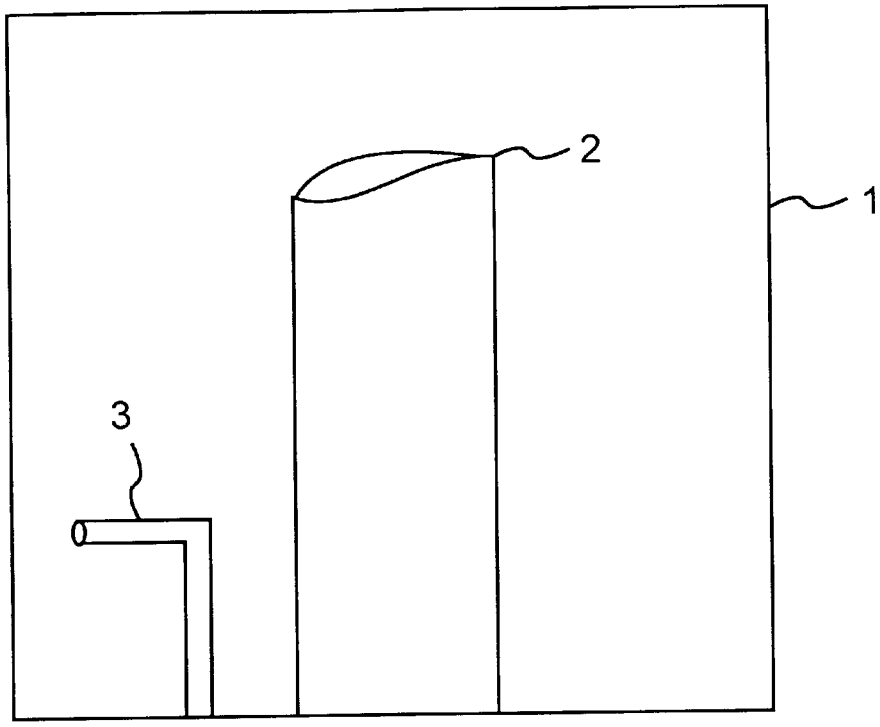
Fig. 1 (Prior Art)
FIG. 1 shows a resonator filter according to the prior art.

FIG. 1 shows a resonator filter according to the prior art, comprising a housing structure 1 and a resonator conductor 2 fastened to the housing structure 1; The resonator filter additionally comprises a regulating means 3, by which the frequency band of the resonator filter is regulated. In the resonator filter of FIG. 1, the regulating means 3 is fastened to the housing structure 1 close to the fixing point of the resonator conductor 2. However, a resonator filter implemented in this way has been difficult to regulate to the correct frequency band.

Figure 2:
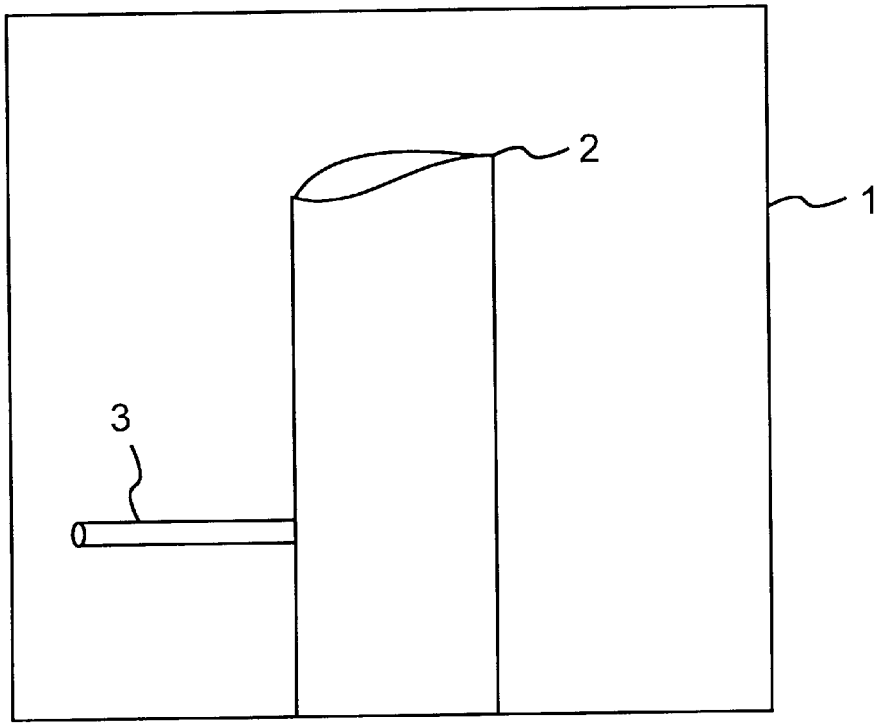
Fig. 2 (Prior Art)
FIG. 2 shows another resonator filter according to the prior art.

FIG. 2 shows another resonator filter according to the prior art, comprising a housing structure 1 and a resonator conductor 2 fastened to the housing structure 1. The resonator filter also comprises a regulating means 3, by which the frequency band of the resonator filter is regulated. In the resonator filter of FIG. 2, the regulating means 3 is fastened to the resonator conductor 2. The regulating means 3 is fastened to the resonator conductor 2 by soldering. However, the fastening arid structure of the regulating means 3 have caused problems with tuning the resonator fitter to the correct frequency band.

Figure 3:
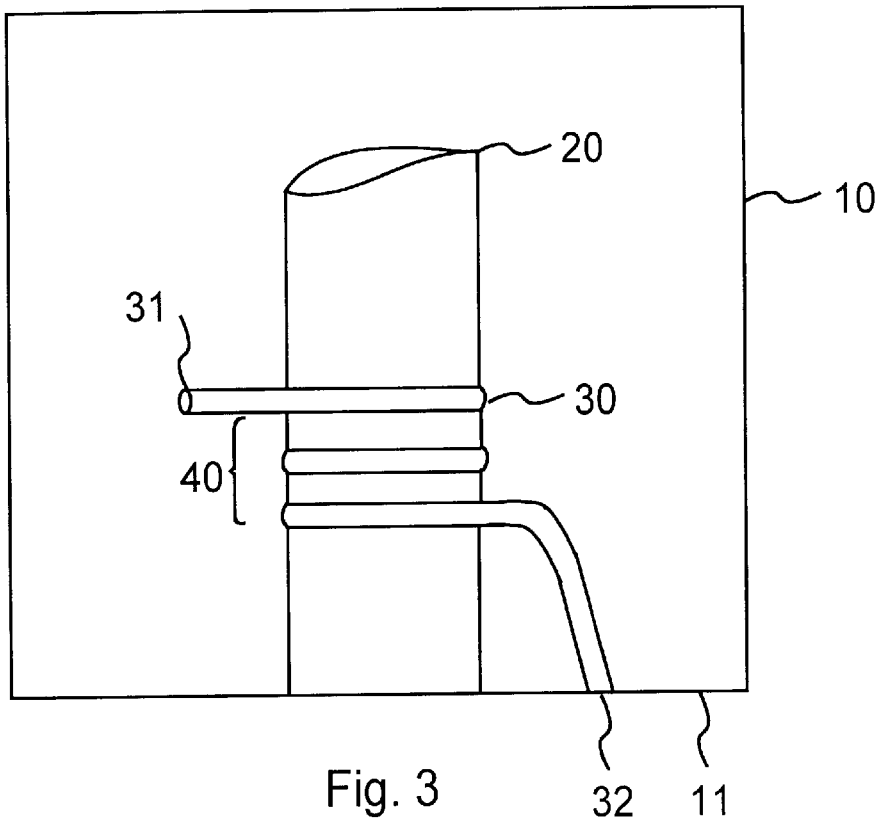
FIG. 3 shows a first embodiment of a resonator filter according to the invention.

FIG. 3 shows a first embodiment of a resonator filter according to the invention, comprising a housing structure 10 and a resonator conductor 20. The housing structure 10 comprises a bottom part 11, which simultaneously forms the ground level of the resonator filter. The resonator conductor 20 is fastened to the bottom part 11 of the housing structure 10 of the resonator filter,. The housing structure 10 and the resonator conductor 20 are made of a well-conductive material. The housing Structure 10 may be made of aluminium, for instance. The resonator conductor 20 is formed for instance of thin copper wire having a thickness of about 1.5 mm. The resonator conductor 20 is fastened to the housing structure 10 by soldering or by a screw, for example.

The resonator filter of FIG. 3 comprises a regulating means 30 preferably made of copper wire, for example. The resonator filter is regulated and tuned to the correct frequency band by the regulating means 30 itself. The regulating means 30 is positioned substantially close to the ground level of the resonator filter, i.e. at a low-impedance point. The regulating means 30 is preferably made of wire wound to a coil-like 40 shape. The regulating means 30 is preferably insulated from the resonator conductor 20 by manufactu ring the regulating means 30 of an enamel coated wire, for instance.

The resonator filter filters, i.e. attenuates, some frequencies very much. Other frequencies are not filtered, but the frequencies get easily through the filter. In the frequency response of the resonator filter, that frequency band which is firstly limited by the frequencies to be filtered and secondly by the frequencies not to be filtered is called a duplex spacing. The solution of the invention changes the size of the duplex spacing.

The regulating means 30 comprises a first end 31 and a second end 32. The second end 32 of the regulating means 30 is preferably coupled to the bottom part 11 of the housing structure 10, i.e. to the ground level. The second end 32 of the regulating means 30 is coupled to the ground level by sold ring, for instance. The regulating means 30 is coupled around the resonator conductor 20 in such a way that the regulating means 30 forms an inductive coupling between the regulating means 30 and the resonator conductor 20.

The regulating means 30 wound of wire is fastened around the resonator conductor 20 in such a way that the regulating means 30 forms a mechanically stable connection to the resonator conductor 20. Thanks to the avoided, for instance. If the inductive coupling of the resonator filter is changed, the frequency band of the resonator filter changes as well.

The size of the inductive coupling can be increased by increasing the number of turns of the regulating means 30, which increases the inductance of the regulating means 30. A change in the inductance of the regulating means 30 influences the size of the frequency band of the resonator filter. The frequency band is also dependent on the thickness of the resonator conductor 20 and on the distance between the turns of the regulating means 30.

The second end 32 of the regulating means 30 is preferably coupled to the ground level in such a way that the distance between the fixing point of the resonator conductor 20 and the regulating means 30 is essentially equal to the distance between that point and the second end 32. At the first end 31, the resonator filter can also be coupled to another resonator filter. In FIG. 3, the second end 32 of the regulating means 30 is directed towards the ground level. The frequency response and the frequency band of the resonator filter can be influenced by changing the distance between the regulating means 30 and the bottom 11 of the housing structure 10. In the solution of the figure, the regulating means 30 is insulated from the resonator conductor 20 in such a way that, at least at the coil-like 40 shape, there is an insulating layer between the regulating means 30 and the resonator conductor 20.

Figure 4:
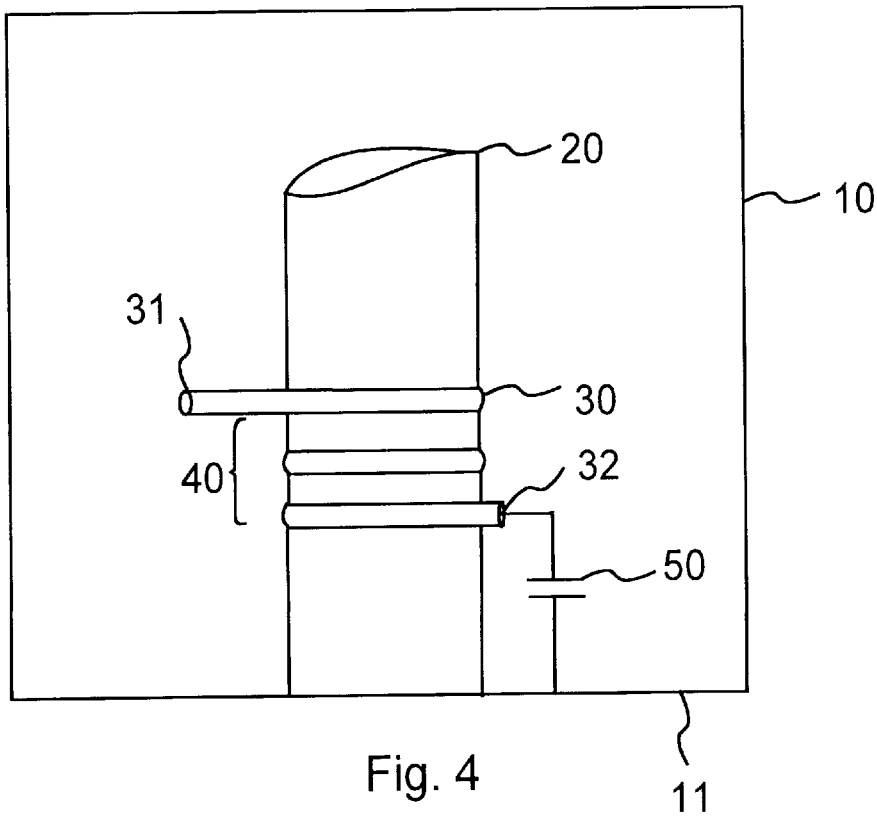
FIG. 4 shows a second embodiment of the resonator filter according to the solution.

FIG. 4 shows another embodiment of the resonator filter according to the solution, also comprising a housing structure 10 and a resonator conductor 20. The housing structure 10 comprises a bottom part 11, which simultaneously constitutes the ground level. The resonator conductor 20 is fastened to the bottom part 11 of the housing structure 10 of the resonator filter. The resonator filter composer a regulating means 30, which is wound to a coil-like 40 shape around the resonator conductor 20. The regulating means 30 comprises a first end 31 and a second end 32. The second end 32 of the regulating means is directed preferably towards the ground level.

In the preferred embodiment of the invention according to FIG. 4, the second end 32 of the regulating means 30 is not fastened directly to the ground level. In this solution, the coupling to the ground level takes place by a capacitive coupling. The capacitive coupling influences the frequency response of the resonator filter. In the solution of the figure, the capacitive coupling has preferably been increased in such a way that the resonator filter comprises a capacitor 50 between the second end 32 of the regulating means and the ground level. In addition, the second end 32 can be galvanically insulated from the ground level.

In the solution of the figure, the regulating means 30 around the resonator conductor 20 is wound to the coil-like 40 shape. Accordingly, the regulating means 30 is coupled to the ground level via the capacitor 50, whereby the size of the capacitive coupling between the resonator conductor 20 and the ground level has changed. The frequency band of the resonator filter is regulated to a desired point and size by changing the capacitive coupling.

Moreover, it appears from the figure clearly that the regulating means 30 is substantially transverse to the propagation direction of the pin-like resonator conductor 20. Further, the regulating means 30 forms at least one turn around the resonator conductor 20 transversely to the propagation direction of the resonator conductor 20. If the resonator conductor 20 is pin-like, the regulating means 30 forms at least one substantially transverse turn with respect to the longitudinal direction of the resonator pin.

Figure 5:
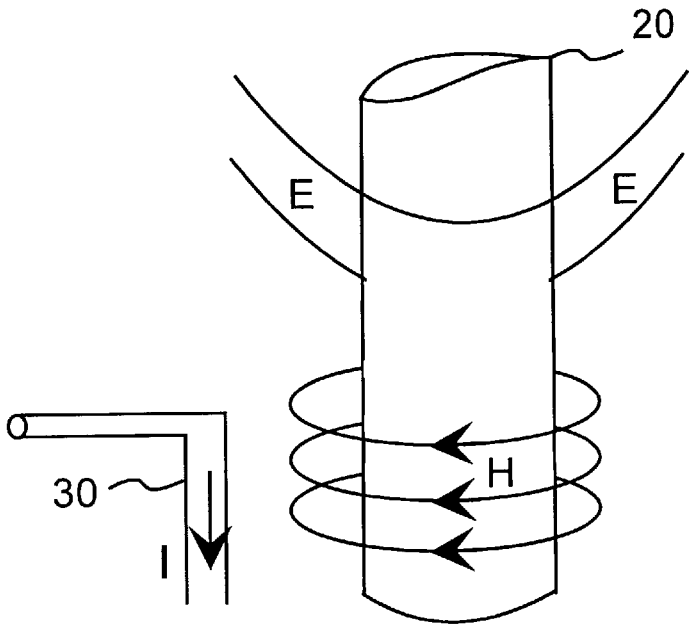
Fig. 5 (Prior Art)
FIG. 5 shows an example of a resonator filter according to the prior art.

FIG. 5 shows an example of a prior art resonator filter, in which a relatively strong current I flowing in the vicinity of the low-impedance end of the resonator causes a strong magnetic field H, which provides a strong connection to a transverse conductor in the magnetic field. Reference mark E designates an electric field. In the solution of the invention, the regulating means 30 is substantially transverse to the propagation direction of the resonator conductor 20, which makes it possible to reduce the strong connection of the magnetic field, whereby the regulation of the resonator filter is not too sensitive.

Figure 6:
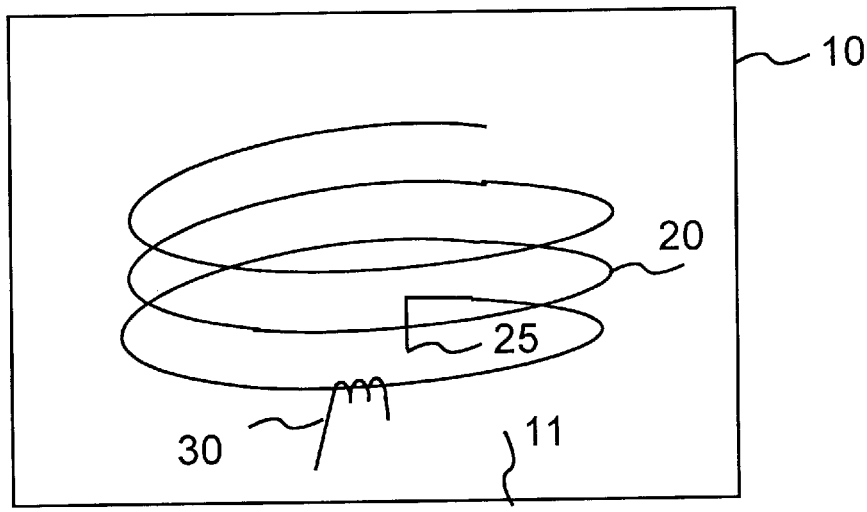
FIG. 6 shows a resonator filter comprising a helical resonator conductor.

FIG. 6 shows a resonator filter formed of a wound resonator conductor 20. In practice, the resonator filter of the figure is a helix resonator, preferably comprising several turns. A regulating means 30 of the resonator filter forms at least one substantially transverse turn around the conductor of the helix coil in such a way that the regulating means 30 forms at least one turn around the resonator conductor 20 transversely to the propagation direction of the resonator conductor. The figure shows a point 25 designating a low-impedance point of the resonance filter. The turn or turns of the regulating means 30 have been formed around the conductor of the coil situated at the low-impedance end of the wound resonator conductor 20.

Figure 7:
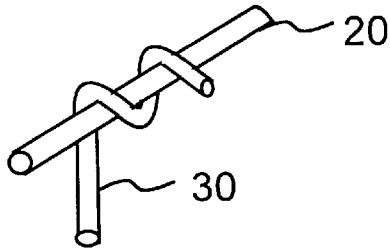
FIG. 7 shows turns of a regulating means in more detail.

FIG. 7 shows in more detail how turns of a regulating means 30 are wound with respect to the propagation direction of a resonator conductor 20. In the solution of the figure, a transverse turn of the regulating means 30 around the resonator conductor preferably touches the resonator conductor 20 almost along the whole turn. The regulating means 30 is formed of insulated wire, by which the regulating means 30 is insulated from the resonator conductor 20.

Though the invention is described above by referring to the example of the attached drawings, it is clear that the invention is not restricted to it, but it can modified in many ways within the scope of the inventive idea set forth in the attached claims.

What is claimed is:

1. Resonator filter comprising a housing structure (10), at least one resonator conductor (20) in the housing structure, and a regulating means (30) for itself regulating the frequency band of the resonator filter, characterised in that the regulating means (30) is substantially transverse to the propagation direction of the resonator conductor and such that the regulating means (30) forms at least one turn around the resonator conductor (20) transversely to the propagation direction of the resonator conductor.

2. Resonator filter according to claim 1, characterised in that, when the resonator conductor (20) is a helix coil, the regulating means (30) forms at least one essentially transverse turn around the conductor of the helix coil.

3. Resonator filter according to claim 1, characterised in that, when the resonator conductor (20) is a longitudinal resonator pin, the regulating means (30) forms at least one turn substantially transverse to the longitudinal direction of the resonator pin.

4. Resonator filter according to claim 2, characterised in that when the helix coil comprises several tums, a turn of the regulating means (30) is formed around the conductor of the coil at the low-impedance end of the resonator conductor.

5. Resonator filter according to claim 1, characterised in that a transverse turn of the regulating means (30) around the resonator conductor (20) touches the resonator conductor along almost the whole turn.

6. Resonator filter according to claim 1, characterised in that the regulating means (30) is insulated from the resonator conductor (20).

7. Resonator filter according to claim 1, characterised in that the regulating means (30) is substantially close to the low-impedance point of the resonator conductor (20).

8. Resonator filter according to claim 1, characterised in that the regulating means (30) is wound in turns around the resonator conductor (20).

9. Resonator filter according to claim 8, characterised in that the turns form a coil (40) shape.

10. Resonator filter according to claim 1, characterised in that the regulating means (30) is in contact with the housing structure (10).

11. Resonator filter according to claim 1, characterised in that the regulating means (30) comprises a first end (31) and a second end (32), the second end being galvanically insulated from the ground level.

* * * * *